US005785305A

United States Patent [19]

Stalker

[11] Patent Number: 5,785,305

[45] Date of Patent: Jul. 28, 1998

[54] ADJUSTABLE WOODWORKING CLAMP

[76] Inventor: Kirk T. Stalker, 561 Antigua Crescent, Oshawa, Ontario, Canada, L1J 6B5

[21] Appl. No.: 911,547

[22] Filed: Aug. 14, 1997

[51] Int. Cl.[6] ..... B25B 1/20

[52] U.S. Cl. ..... 269/37; 269/41; 269/228; 269/236

[58] Field of Search ..... 269/37, 41, 902, 269/235, 236, 228

[56] References Cited

U.S. PATENT DOCUMENTS

| | | | |
|---|---|---|---|
| 2,941,557 | 6/1960 | Baprawski | 269/41 |
| 3,888,476 | 6/1975 | Barton | 269/41 |
| 4,209,164 | 6/1980 | Brothers | 269/37 |
| 5,482,263 | 1/1996 | Kutzleb | 269/41 |

*Primary Examiner*—Robert C. Watson

[57] ABSTRACT

A new adjustable woodworking clamp for holding elongated workpieces end to end for being joined. The inventive device includes an elongated base plate. A fixed arm is fixedly secured to the base plate. The fixed arm extends angularly upwardly from the base plate for supporting a first workpiece. A pair of shoulder bolts extend through the elongated base plate. A sliding plate is provided having a pair of slots therethrough for coupling with the pair of shoulder bolts. The sliding plate has an interior flared end. A sliding arm is secured to the sliding plate. The sliding arm extends angularly upwardly with respect to the base plate for supporting a second workpiece to be joined to the first workpiece at a predetermined angle. A pair of clamps are coupled with respect to upper ends of the fixed arm and the sliding arm for securement of the workpieces.

6 Claims, 2 Drawing Sheets

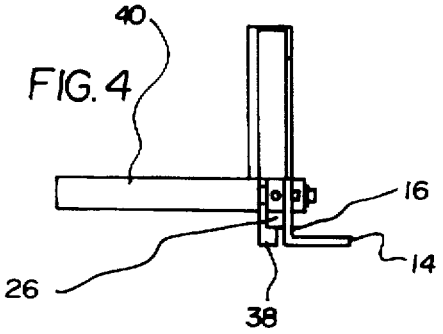
FIG. 4
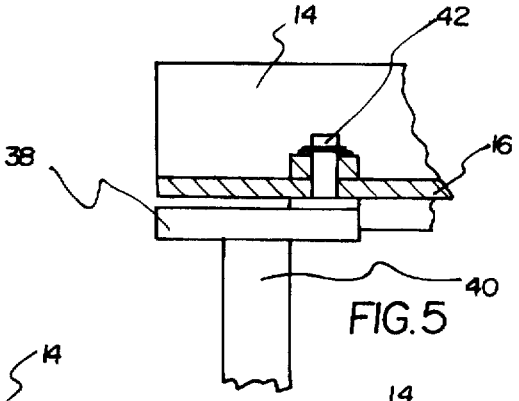
FIG. 5
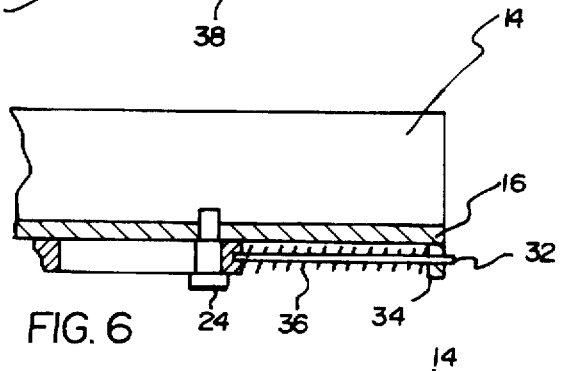
FIG. 6
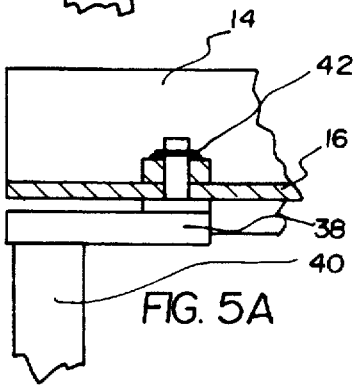
FIG. 5A
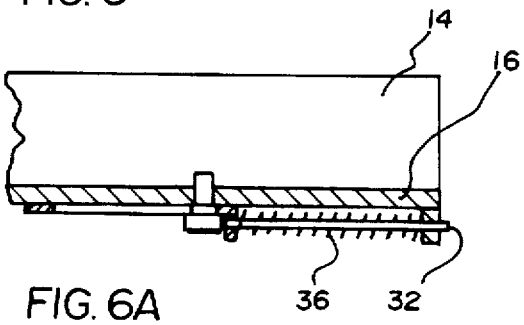
FIG. 6A
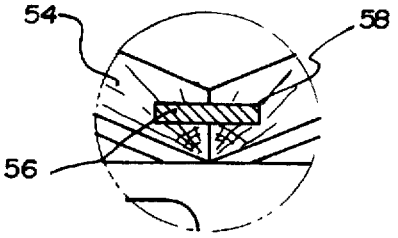
FIG. 7
FIG. 8
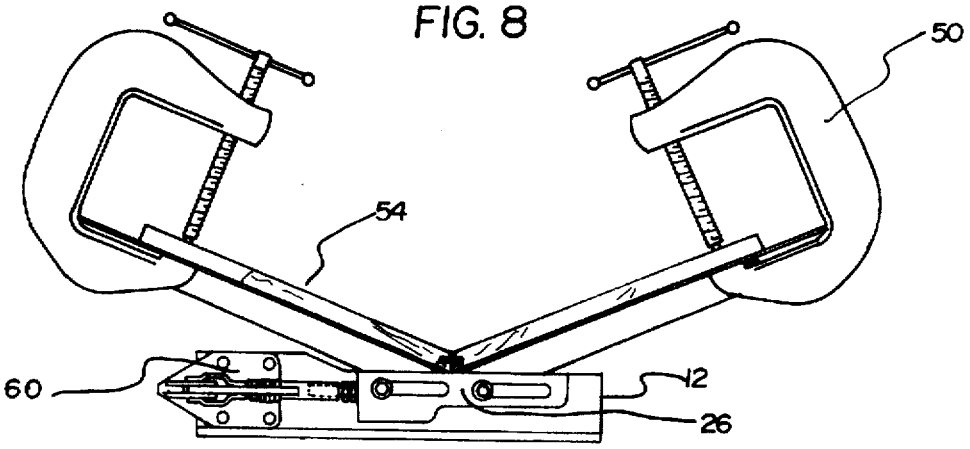

ADJUSTABLE WOODWORKING CLAMP

BACKGROUND OF THE INVENTION

1. Field of the Invention

The present invention relates to clamping assemblies and more particularly pertains to a new adjustable woodworking clamp for holding elongated workpieces end to end for being joined.

2. Description of the Prior Art

The use of clamping assemblies is known in the prior art. More specifically, clamping assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art clamping assemblies include U.S. Pat. No. 5,401,354 to Colucci; U.S. Pat. No. 4,984,775 to Kahlke; U.S. Pat. No. 4,377,959 to DeCarolis; U.S. Pat. No. 4,247,090 to Hahn et al.; U.S. Pat. No. 3,893,362 to Schneider et al.; and U.S. Pat. No. Des. 348,816 to Degen.

While these devices fulfill their respective, particular objectives and requirements, the aforementioned patents do not disclose a new adjustable woodworking clamp. The inventive device includes an elongated base plate. A fixed arm is fixedly secured to the base plate. The fixed arm extends angularly upwardly from the base plate for supporting a first workpiece. A pair of shoulder bolts extend through the elongated base plate. A sliding plate is provided having a pair of slots therethrough for coupling with the pair of shoulder bolts. The sliding plate has an interior flared end. A sliding arm is secured to the sliding plate. The sliding arm extends angularly upwardly with respect to the base plate for supporting a second workpiece to be joined to the first workpiece at a predetermined angle. A pair of clamps are coupled with respect to upper ends of the fixed arm and the sliding arm for securement of the workpieces.

In these respects, the adjustable woodworking clamp according to the present invention substantially departs from the conventional concepts and designs of the prior art, and in so doing provides an apparatus primarily developed for the purpose of holding elongated workpieces end to end for being joined.

SUMMARY OF THE INVENTION

In view of the foregoing disadvantages inherent in the known types of clamping assemblies now present in the prior art, the present invention provides a new adjustable woodworking clamp construction wherein the same can be utilized for holding elongated workpieces end to end for being joined.

The general purpose of the present invention, which will be described subsequently in greater detail, is to provide a new adjustable woodworking clamp apparatus and method which has many of the advantages of the clamping assemblies mentioned heretofore and many novel features that result in a new adjustable woodworking clamp which is not anticipated, rendered obvious, suggested, or even implied by any of the prior art clamping assemblies, either alone or in any combination thereof.

To attain this, the present invention generally comprises an elongated base plate having an L-shaped cross-section. The base plate has a lower horizontal segment and an upper vertical segment. A fixed arm is included having an L-shaped cross-section. The fixed arm has a lower vertical segment and an upper horizontal segment. The lower vertical segment is fixedly secured to the upper vertical segment of the base plate. The fixed arm extends angularly upwardly from the base plate at an angle of 22-½ degrees. A pair of shoulder bolts extend through the upper vertical segment of the elongated base plate. A sliding plate is provided having a pair of slots therethrough for coupling with the pair of shoulder bolts. The sliding plate has an interior flared end. An outer end of the sliding plate has a rod extending linearly therefrom. The rod extends through a brace plate secured to an end of the upper vertical segment of the base plate. The rod has a compression spring disposed thereon between the outer end of the sliding plate and the brace plate. An actuator wheel is eccentrically coupled with the upper vertical segment of the base member in an abutting relationship with the interior flared end of the sliding plate. The actuator wheel has a handle extending outwardly therefrom. A sliding arm is included having an L-shaped cross-section. The sliding arm has a lower vertical segment and an upper horizontal segment. A lower end of the lower vertical segment is secured to the sliding plate. The sliding arm extends angularly upwardly with respect to the base plate at an angle of 22-½ degrees. A pair of C-clamps are coupled with respect to upper ends of the fixed arm and the sliding arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable woodworking clamp apparatus and method which has many of the advantages of the clamping assemblies mentioned heretofore and many novel features that result in a new adjustable woodworking clamp which is not anticipated, rendered obvious, suggested, or even implied by any of the prior art clamping assemblies, either alone or in any combination thereof.

It is another object of the present invention to provide a new adjustable woodworking clamp which may be easily and efficiently manufactured and marketed.

It is a further object of the present invention to provide a new adjustable woodworking clamp which is of a durable and reliable construction.

An even further object of the present invention is to provide a new adjustable woodworking clamp which is susceptible of a low cost of manufacture with regard to both materials and labor, and which accordingly is then susceptible of low prices of sale to the consuming public, thereby making such adjustable woodworking clamp economically available to the buying public.

Still yet another object of the present invention is to provide a new adjustable woodworking clamp which provides in the apparatuses and methods of the prior art some of the advantages thereof, while simultaneously overcoming some of the disadvantages normally associated therewith.

Still another object of the present invention is to provide a new adjustable woodworking clamp for holding elongated workpieces end to end for being joined.

Yet another object of the present invention is to provide a new adjustable woodworking clamp which includes an elongated base plate. A fixed arm is fixedly secured to the base plate. The fixed arm extends angularly upwardly from the base plate for supporting a first workpiece. A pair of shoulder bolts extend through the elongated base plate. A sliding plate is provided having a pair of slots therethrough for coupling with the pair of shoulder bolts. The sliding plate has an interior flared end. A sliding arm is secured to the sliding plate. The sliding arm extends angularly upwardly with respect to the base plate for supporting a second workpiece to be joined to the first workpiece at a predetermined angle. A pair of clamps are coupled with respect to upper ends of the fixed arm and the sliding arm for securement of the workpieces.

Still yet another object of the present invention is to provide a new adjustable woodworking clamp that joins wood pieces at 135 degree angles.

Even still another object of the present invention is to provide a new adjustable woodworking clamp that reduces the amount of time and effort required to join workpieces at this angle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an end view of the present invention.

FIG. 5 is a top plan view of the actuator of the present invention.

FIG. 5A is a top plan view of the actuator of the present invention.

FIG. 6 is a top plan view of the sliding plate of the present invention.

FIG. 6A is a top plan view of the sliding plate of the present invention.

FIG. 7 is a side view illustrating the coupling of the workpieces.

FIG. 8 is a side view of a second embodiment of the present invention.

DESCRIPTION OF THE PREFERRED EMBODIMENT

Figure 1:
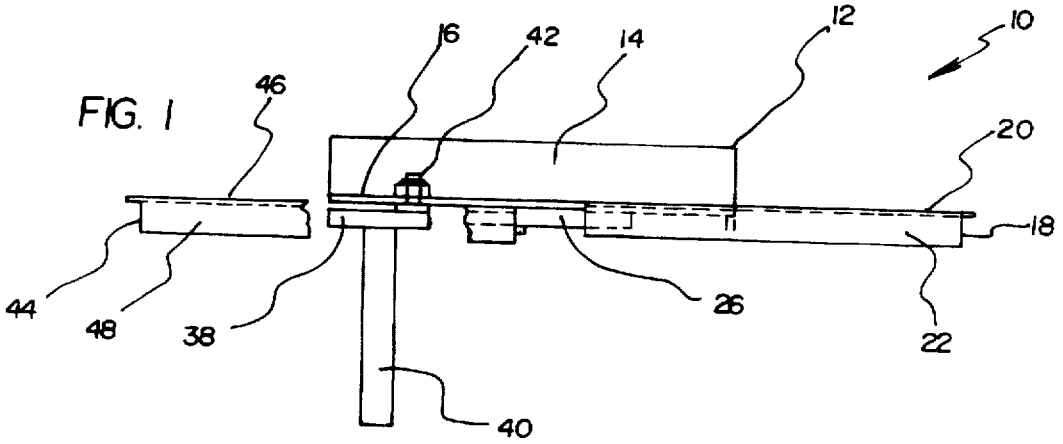
FIG. 1 is a top plan view of a new adjustable woodworking clamp according to the present invention.
Figure 2:
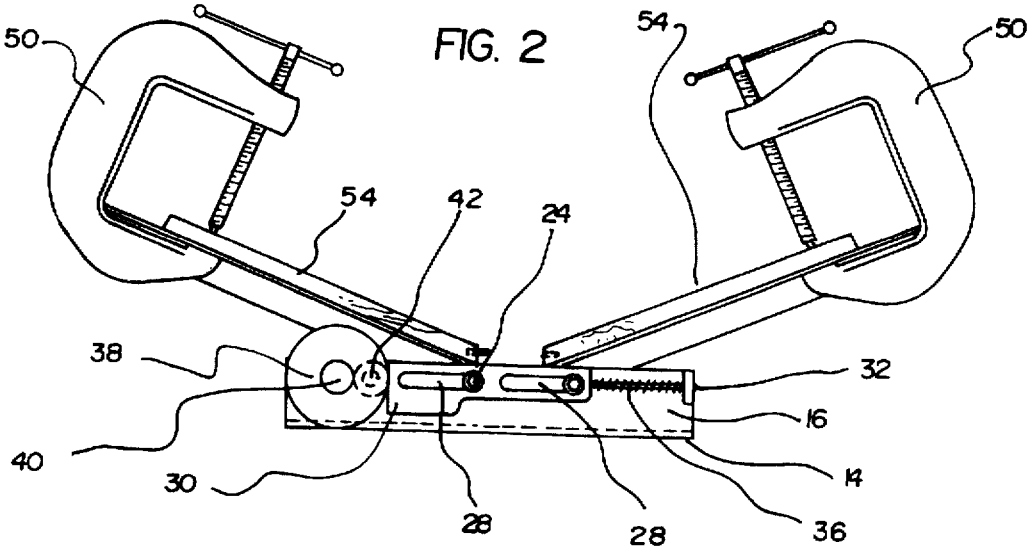
FIG. 2 is a side view of the present invention.
Figure 3:
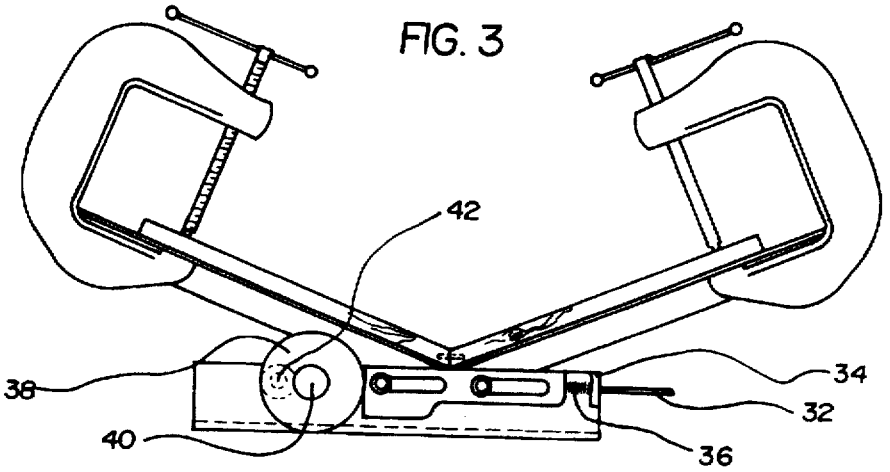
FIG. 3 is a side view of the present invention in an engaged orientation.

With reference now to the drawings, and in particular to FIGS. 1 through 8 thereof, a new adjustable woodworking clamp embodying the principles and concepts of the present invention and generally designated by the reference numeral 10 will be described.

As best illustrated in FIGS. 1 through 8, the adjustable woodworking clamp 10 comprises an elongated base plate 12 having an L-shaped cross-section. The base plate 12 has a lower horizontal segment 14 and an upper vertical segment 16.

A fixed arm 18 is included having an L-shaped cross-section. The fixed arm 18 has a lower vertical segment 20 and an upper horizontal segment 22. The lower vertical segment 20 is fixedly secured to the upper vertical segment 16 of the base plate 12. The fixed arm 18 extends angularly upwardly from the base plate 12 at an angle of 22-½ degrees. This angle represents the preferred embodiment in order to accomplish the joining of two work pieces in an end to end relationship at an angle of 135 degrees.

A pair of shoulder bolts 24 extend through the upper vertical segment 16 of the elongated base plate 12.

A sliding plate 26 is provided having a pair of slots 28 therethrough for coupling with the pair of shoulder bolts 24. The sliding plate 26 has an interior flared end 30. An outer end of the sliding plate 26 has a rod 32 extending linearly therefrom. The rod 32 extends through a brace plate 34 secured to an end of the upper vertical segment 16 of the base plate 12. The rod 32 has a compression spring 36 disposed thereon between the outer end of the sliding plate 26 and the brace plate 34.

An actuator wheel 38 is eccentrically coupled with the upper vertical segment 16 of the base plate 12 in an abutting relationship with the interior flared end 30 of the sliding plate 26. The actuator wheel 38 has a handle 40 extending outwardly therefrom. The actuator wheel 38 is coupled with the base plate 12 by an axle pin 42. A user grasps the handle 40 and rotates the actuator wheel 38 inwardly to bias the sliding plate 26 inwardly against the bias of the compression spring 36 (Note FIG. 3).

A sliding arm 44 is included having an L-shaped cross-section. The sliding arm 44 has a lower vertical segment 46 and an upper horizontal segment 48. A lower end of the lower vertical segment 46 is secured to the sliding plate 26. The sliding arm 44 extends angularly upwardly with respect to the base plate 12 at an angle of 22-½ degrees.

A pair of C-clamps 50 are coupled with respect to upper ends of the fixed arm 18 and the sliding arm 44.

In use, the two workpieces 54 in question are positioned on the fixed arm 18 and the sliding arm 44 and secured by the C-clamps 50 or other clamping means. The facing ends of the workpieces are fitted with male and female couplers such as biscuits 56 and associated apertures 58 with glue. Note FIG. 7. The handle 40 is rotated thereby causing the actuator wheel 38 to bear on the interior flared end 30 of the sliding plate 26 thereby causing the sliding arm 44 to move together with the fixed arm 18 and attaching the ends of the two workpieces 54 together.

Alternately, the actuator wheel 38 and the compression spring 36 and the rod 32 can be replaced by a toggle clamp 60 that is secured to the base plate 12 and the sliding plate 26 whereby manipulation of the toggle clamp 60 will bias the sliding arm 44 towards the fixed arm 18. Note FIG. 8.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable woodworking clamp comprising:

an elongated base plate having an L-shaped cross-section, the base plate having a lower horizontal segment and an upper vertical segment;

a fixed arm having an L-shaped cross-section, the fixed arm having a lower vertical segment and an upper horizontal segment, the lower vertical segment fixedly secured to the upper vertical segment of the base plate, the fixed arm extending angularly upwardly from the base plate at an angle of 22-½ degrees;

a pair of shoulder bolts extending through the upper vertical segment of the elongated base plate;

a sliding plate having a pair of slots therethrough for coupling with the pair of shoulder bolts, the sliding plate having an interior flared end, an outer end of the sliding plate having a rod extending linearly therefrom, the rod extending through a brace plate secured to an end of the upper vertical segment of the base plate, the rod having a compression spring disposed thereon between the outer end of the sliding plate and the brace plate;

an actuator wheel eccentrically coupled with the upper vertical segment of the base plate in an abutting relationship with the interior flared end of the sliding plate, the actuator wheel having a handle extending outwardly therefrom;

a sliding arm having an L-shaped cross-section, the sliding arm having a lower vertical segment and an upper horizontal segment, a lower end of the lower vertical segment secured to the sliding plate, the sliding arm extending angularly upwardly with respect to the base plate at an angle of 22-½ degrees; and a pair of C-clamps coupled with respect to upper ends of the fixed arm and the sliding arm.

2. An adjustable woodworking clamp comprising:

an elongated base plate;

a fixed arm fixedly secured to the base plate, the fixed arm extending angularly upwardly from the base plate;

a pair of shoulder bolts extending through the elongated base plate;

a sliding plate having a pair of slots therethrough for coupling with the pair of shoulder bolts, the sliding plate having an interior flared end;

a sliding arm secured to the sliding plate, the sliding arm extending angularly upwardly with respect to the base plate; and a pair of clamps coupled with respect to upper ends of the fixed arm and the sliding arm.

3. The adjustable woodworking clamp as set forth in claim 2 and further including an actuator wheel eccentrically coupled with the base plate in an abutting relationship with the interior flared end of the sliding plate, the actuator wheel having a handle extending outwardly therefrom.

4. The adjustable woodworking clamp as set forth in claim 3 wherein an outer end of the sliding plate has a rod extending linearly therefrom, the rod extends through a brace plate secured to an end of the upper vertical segment of the base plate, the rod has a compression spring disposed thereon between the outer end of the sliding plate and the brace plate.

5. The adjustable woodworking clamp as set forth in claim 2 wherein the fixed arm and the sliding arm extend angularly upwardly with respect to the base plate at an angle of 22-½ degrees.

6. The adjustable woodworking clamp as set forth in claim 2 and further including a toggle clamp coupled with respect to the base plate and the sliding plate.

* * * * *